United States Patent [19]

Tamulevich

[11] 4,272,926

[45] Jun. 16, 1981

[54] FACE FINISHING TOOL FOR FIBER OPTIC COMMUNICATION CABLE

[75] Inventor: Thomas W. Tamulevich, Southbridge, Mass.

[73] Assignee: Epoxy Technology Inc., Billerica, Mass.

[21] Appl. No.: 91,076

[22] Filed: Nov. 5, 1979

[51] Int. Cl.[3] ..... B24B 41/06

[52] U.S. Cl. ..... 51/216 R; 29/525; 51/221; 51/131.2

[58] Field of Search ..... 51/216 R, 216 LP, 216 T, 51/216 A, 217 LP, 221, 131.2, 131.3, 131.4; 29/450, 525

[56] References Cited

U.S. PATENT DOCUMENTS

| | | | |
|---|---|---|---|
| 2,353,171 | 7/1944 | MacConnell | 51/216 P |
| 2,984,951 | 5/1961 | Coons | 51/131.2 |
| 3,158,968 | 12/1964 | Ness | 51/216 R |
| 3,559,346 | 2/1971 | Paola | 51/131.4 |
| 3,763,611 | 10/1973 | Duhring | 51/216 R |

OTHER PUBLICATIONS

Amphenol Company Catalog, "Polishing Tool for Cable Terminals" p. 7, Dated prior to 11-5-79.

*Primary Examiner*—Harold D. Whitehead
*Attorney, Agent, or Firm*—Kenway & Jenney

[57] ABSTRACT

A tool for finishing a termination on a fiber optic cable has a base element cast of synthetic resin material to form a reference surface and a mounting passage, and mounts a connector element in the passage adjustably for calibrated repositioning relative to the reference surface.

7 Claims, 3 Drawing Figures

FACE FINISHING TOOL FOR FIBER OPTIC COMMUNICATION CABLE

BACKGROUND OF THE INVENTION

This invention relates to the improved manufacture of a tool for the precision finishing of fiber optic cable. More particularly, it provides a construction and a manufacture of such a tool that yield multiple advantages over the prior tool.

Communication cables using fibers of optically transmissive material and which carry signals in the form of light waves are increasingly used in lieu of the traditional cables having copper or like conductors of electrical current. The efficient transfer of optical energy to and from these fiber optic cables requires, among other factors, proper termination of the cable by whatever connector is used. The termination determines such parameters crucial to energy transfer as the location, the orientation and the surface finish of the fiber optic facet. Consequently, after a connector is assembled on a fiber optic cable, the projecting end of the fiber optic bundle is ground and polished to attain a precisely located and highly flat and smooth facet. These finishing operations also orient the facet precisely at a selected angle relative to the axis of the fiber bundle. In most instances, the facet is perpendicular to the fiber axis.

The conventional support for the cable connector during these grind and polish finishing operations in a machined precision tool that forms a reference surface against which the fiber bundle is finished. The tool mounts the cable connector precisely at a selected angle relative to the reference surface and with the end of the fiber optic bundle positioned to be ground to and polished along the reference surface. For this purpose, The Amphenol Company, for example, markets a one-piece polishing tool machined of a 300-series stainless steel.

The conventional machined finishing tool is costly, but it must be discarded after a limited number of uses due to abrasive wear of the reference surface by the grind and polish operations. It is also known to use a finishing tool for fiber optic communication cables that is assembled of two machined parts, one of which provides the reference surface and the other of which attaches to the cable termination being finished. The two parts of the tool are assembled in a manner that allows them to be selectively repositioned to re-establish desired dimensionals after abrasive wear. This two-piece finishing tool, however, continues to be relatively costly.

OBJECTS OF THE INVENTION

It is accordingly an object of this invention to provide an improved finishing tool for grinding and polishing the fiber optic bundle in a terminated communication cable. A more particular object is to provide such a tool that is less costly than prior tools. Another object is to provide a less costly tool of the above character that allows for recalibration to offset abrasive wear. Other objects of the invention will in part be obvious and will in part appear hereinafter.

SUMMARY OF THE INVENTION

A tool for finishing the facet of a fiber optic communication cable termination, in accordance with the invention, has a two-part construction with a base element that is cast and which mounts a connector element. The cast manufacture of the base element has been found to provide the precision reference surface used for the finishing of the terminated fiber optic bundle. The cast construction has also been found to have greater abrasion resistance than the machined metal previously used. A further feature of the cast base element is that it mounts the connector element with the desired precise orientation relative to the reference surface. The cast construction can attain these features in the "as cast" form, without requiring machining or other operations subsequent to curing the casting.

A preferred practice of the invention casts the base element of the tool of epoxy resin. Further, the preferred manufacture includes control of the curing temperature for the cast resin material.

It has also been found that the cast polishing tool base element mounts the connector element of the tool so that it can be repositioned. This not only facilitates the initial precision assembly of the tool, but it is desired for recalibrating the tool after repeated use causes measurable abrasive wear. This recalibrating adjustable mounting of the connector element is similar to prior art practice considered available only with a machined base construction.

The new finishing tool thus provides advantages of the prior machined construction to the same or greater extent, in addition to overcoming the high cost disadvantage attendant with the machined construction.

The invention accordingly embraces an article of manufacture possessing the features, properties, and relations exemplified in the article hereinafter described, and the several steps and the relation of one or more of such steps with respect to others for attaining such an article. The scope of the invention is indicated in the claims.

BRIEF DESCRIPTION OF THE DRAWINGS

For a fuller understanding of the nature and objects of the invention, reference should be had to the following detailed description and the accompanying drawings, in which.

DESCRIPTION OF ILLUSTRATED EMBODIMENT

Figure 1:
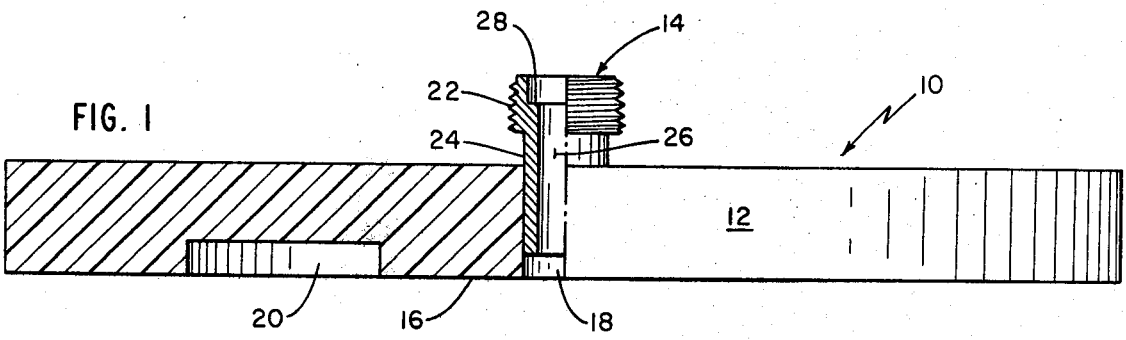
FIG. 1 is a side elevation view, partly in section, of a cable-finishing tool according to the invention.

A finishing tool 10 according to the invention has, as FIG. 1 shows, a cast base element 12 that mounts a connector element 14. The illustrated base element 12 is a right cylindrical disc with a reference surface 16 and having an axial through passage 18. An annular groove 20, preferably concentric with the passage 18, recesses the reference surface 16. The reference surface 16, aside from the relief provided by the groove 20, is smooth and flat, and the passage 18 is perpendicular to it. The remaining surfaces of the base element, i.e. the top surface and the outer peripheral surface, are of lesser importance.

The connector element 14 is a threaded stud selected to mate with the cable-terminating connector with which the tool is to be used. It typically has external threads 22 and a cylindrical mounting shank 24. The connector element has an inner cylindrical bore 26 relieved at the outer, threaded end to provide an annular locating shoulder 28. The connector element typically is machined of metal.

Figure 2:
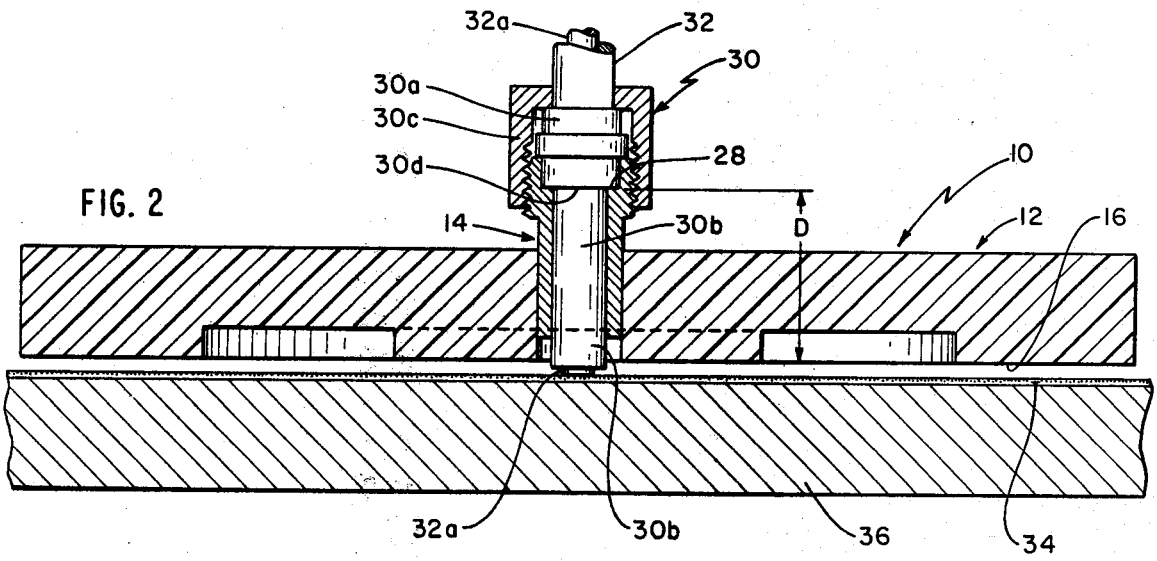
FIG. 2 is a cross-sectional, side view of the tool of FIG. 1 in use.

The connector element 14 is mounted to the base element 12 with a press fit engagement of the mounting shank 24 within the passage 18. The connector element extends within the passage to space the locating shoulder 28 a selected distance from the reference surface 16. This distance, designated as the distance D in FIG. 2, is precisely maintained because it determines the location of the optical facet on a fiber optic cable finished with the tool. The location of that facet relative to the cable connector is important in attained maximum coupling of light energy to and from the terminated cable.

With further reference to FIG. 1, the finishing tool base element 12 is cast in a precision mold to attain directly from the cast manufacture the final dimensions and surface finishes. It has been found that casting the base element can provide the smooth reference surface 16 and can provide the passage 18 precisely perpendicular to the reference surface. The cast manufacture can also form the passage 18 with the precisely dimensioned cylindrical shape for mounting the connector element 14. The cast manufacture in addition provides the groove 20 and the other illustrated geometrical features of the base element.

The material from which the base element is cast has a small coefficient of thermal expansion to attain dimensional precision directly from the casting operation. The material further is selected to have high abrasion resistance and sufficiently high compressive strength to mount the connector element with a press fit, as described. It has been found that synthetic resin material can meet these requirements. A highly cross-linked polymerized symthetic resin is considered preferable to enchance high dimensional stability throughout the casting and curing operations. A specific example of synthetic resin which meets the foregoing requirements is epoxy resins which are thermally or ultraviolet curable. A specific epoxy resin suitable for practice of the invention is marketed by Epoxy Technology Inc. in Billerica, Mass. U.S.A., under the designation EPO-TEK H77.

By way of illustrative example, a finishing tool base element 12 precision cast of EPO-TEK H77 epoxy as described above has 40 grams by weight of part A mixed with six grams of part B, which is the hardener. According to an illustrative preferred manufacture with this resin, a mold release, such as the Contour Chemical Company XA 2085 mold release, was applied to the mold; and the mold and the epoxy mixture were each preheated in a 65° Centigrade environment for fifteen minutes. The epoxy mixture was poured into the warm mold and allowed to gel at room temperature for approximately one hour. The mold was placed in an oven at 130° Centigrade for two hours, after which the mold was removed from the oven and allowed to cool at room temperature for two hours. The mold, still containing the epoxy casting, was next placed in a freezer at about −10° Centigrade for twenty minutes. Upon removal from the freezer, the epoxy casting was removed from the mold and was ready for use. The two-hour cure at 130° is preferred over the shorter but hotter cure generally used with this epoxy resin. This limited rate of cure is considered to enhance the precision of the cast part by controlling the rate of exotherm in the resin material.

Finishing tool base elements cast in this manner are each found to have a smooth reference surface with whatever contour the mold imparts. The illustrated tool has a flat planar surface 16. Each such base element also has highly precise and accurate perpendicularity of the connector element-receiving passage 18 relative to the reference surface 16. Further, the passage 18 is sufficiently precise and accurately cylindrical at the prescribed inner diameter that the several base elements interchangeably press fit with machined connector elements 14.

Abrasion tests of the reference surface 16 on a cast base element 12 prepared according to the foregoing example, as compared with the abrasion resistance of the corresponding surface of a base element machined of 300-series stainless steel, demonstrate that the cast epoxy part has a significantly higher abrasion resistance. In particular, under a test with a six-hundred grit silicone carbide wet paper, the reference surface of the stainless steel base element was found to have been abraded by 1/10,000ths of an inch after forty abrasive strokes, and by a further 1/10,000ths of an inch after a total of one hundred strokes. By way of contrast, the base element manufactured of cast epoxy in accordance with the invention sustained no measurable abrasive wear after eighty strokes and manifested only 1/10,000ths inch wear after one hundred strokes.

FIG. 2 shows the finishing tool 10 of FIG. 1 assembled with a connector 30 terminating a fiber optic communication cable 32. The illustrated connector 30 shown simplified for clarity, includes a connector body **30*a* that receives the cable outer jacket and a connector sleeve 30*b* that encloses and supports the fiber optic bundle 32*a* of the cable. A retaining nut 30*c* on the connector threads onto the connector element threads 22 to engage an abutment 30*d* on the connector, at the intersection of the sleeve 30*b* with the housing 30*a*, against the connector element locating shoulder 28**.

When the connector 30 is assembled onto the cable 32, both the connector sleeve **30*b* and the cable fiber optic bundle 32*a* project, typically by a few thousandths of an inch further than desired in the finished termination. FIG. 2 shows, with exaggerated dimensions, that when the cable connector 30 is seated in the foregoing manner against the connector element locating shoulder 28, this projection of the connector sleeve and cable bundle projects beyond the reference surface 16** of the finishing tool.

The function of the finishing tool 10 is to facilitate removal of this protruding excess length of the connector sleeve and the cable fiber optic bundle, and to polish the cable facet which they form. For this purpose, after the assembled cable 32 and connector 30 are attached to the finishing tool as shown in FIG. 2, the tool is placed on an abrasive sheet 34 resting on a flat table 36 and moved, typically with repetitive strokes, to grind down the protruding fiber optic bundle and connector sleeve. Successively finer abrasive sheets 34 are used until the end of the fiber optic bundle **32*a* is flush with the reference surface 16 of the finishing tool and is optically smooth and free of scratches. Typically the polishing continues until the facet appears smooth when examined under at least ten power magnification. The relief in the reference surface 16, illustrated as provided by the groove 20, facilitates the movement of the finishing tool 10 relative to the abrasive sheet 34 and accommodates dust and other debris formed during the finishing operations. At this point, the facet of the terminated cable is located exactly at the specified distance D from the connector abutment 30*d*, as desired. The fiber optic communication cable is now properly terminated and will couple optical energy with minimal loss to another similarly terminated cable, to an output element such as a photo-diode, or from an optical source such as a laser diode or a light-emitting diode, whichever the case may be. Moreover, due to the precise perpendicularity of the connector element 14 relative to the reference surface 16**, the resultant polished facet on the terminated cable is highly perpendicular to the cable axis, as desired. (Other prescribed orientations, if desired, can be attained with equal precision.)

Figure 3:
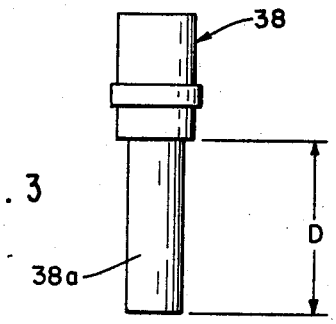
FIG. 3 shows a plug element useful in recalibrating the tool of FIG. 1.

It has also been found that the cast manufacture of the finishing tool base element which the invention provides allows the connector element 14 to be repositioned within the base element passage 18. This is desirable to establish the spacing of the locating shoulder 28 from the reference surface 16, i.e. to establish the dimension D designated in FIG. 2, both for the initial assembly of the connector element 14 with the base element 12 and for recalibrating the finishing tool after it has been subjected to sufficient use to measurably abrade the reference surface. The connector element 14 can be positioned and repositioned within the passage of the finishing tool 10 typically by starting with the connector element 14 only partially inserted into the passage 18, so that the locating shoulder 28 is spaced from the reference surface 16 by more than the desired distance D. With the reference surface 16 of the finishing tool resting on a precise flat table, a gauge plug 38 as shown in FIG. 3 is inserted into the connector element 14. The gauge plug 38 is pressed or tapped down, thereby to further seat the connector element 14 within the passage 28. The gauge plug 38 has a shank 38*a* extending from an abutment for the distance D as FIG. 3 shows, and accordingly the shank bottoms on the supporting table when the connector element is at the proper location within the base element passage 18.

The precision cast manufacture, preferably of selected epoxy resin, of a fiber optic finishing tool base element as described above thus provides a highly precise tool at markedly less cost than the prior machined steel construction considered necessary. The cast manufacture which the invention provides has equal or better dimensional accuracy and precision, abrasion resistance, and recalibration capability. The finishing tool which the invention provides thus is both equal or superior to the prior machine constructions, yet costs only a fraction as much.

It will thus be seen that the objects set forth above, among those made apparent from the preceding description, are efficiently attained. Since certain changes may be made in carrying out the above process and in the articles set forth without departing from the scope of the invention, it is intended that all matter contained in the above description and shown in the accompanying drawing be interpreted as illustrative and not in a limiting sense.

It is also to be understood that the following claims cover all of the generic and specific features of the invention herein described, and all statements of the scope of the invention which, as a matter of language, might be said to fail therebetween.

Having described the invention, what is claimed as new and secured by Letters Patent is:

1. In a facet finishing tool for a terminated fiber optic communication cable, said tool having a reference surface and having a connector element for selectively positioning and locating such a cable coupled therewith relative to the reference surface, said connector element including a cable-abutting locating surface, the improvement in said tool comprising a base element of precision cast material forming, as cast, said reference surface and a mounting passage with selected precise orientation relative to said reference surface, said connector element being mounted to said base element by adjustable press fit within said passage, whereby said cast base element provides said reference surface with selected smoothness and with abrasion resistance, and mounts said connector element with selected precise relative orientation and adjustably for the calibration repositioning of said locating surface in said passage relative to said reference surface.

2. In a finishing tool according to claim 1, the further improvement in which said tool comprises a base element case of epoxy resin.

3. In a finishing tool according to claim 1, the further improvement in which said tool comprises a base element cast of highly cross-linked polymerized synthetic resin.

4. In the manufacture of a facet finishing tool for a terminated fiber optic communication cable, in which the tool has a reference surface and has a connector element for selectively positioning and locating such a cable coupled therewith relative to the reference surface, said connector element having a cable-abutting locating surface for precise location a selected distance from the reference surface, the improvement comprising the steps of precision casting a base element of said tool to form, as cast, said reference surface and a mounting passage precisely oriented relative to said surface, and mounting said connector element to said base element by adjustable press fit within said passage, thereby to provide with said cast base element said reference surface with selected smoothness and with abrasion resistance, and to mount said connector element with selected precise relative orientation and adjustably for the calibration repositioning of said locating surface thereof relative to said reference surface.

5. In the improved manufacture of a finishing tool according to claim 4, the further step of casting said base element of epoxy resin.

6. In the improved manufacture of a finishing tool according to claim 4, the further step of casting said base element of highly cross-linked polymerized synthetic resin.

7. In the improved manufacture of a finishing tool according to claim 4, the further step of casting said base element of epoxy resin and controlling the thermal curing of said cast epoxy to limit the rate of exotherm.

* * * * *

UNITED STATES PATENT AND TRADEMARK OFFICE

CERTIFICATE OF CORRECTION

PATENT NO. : 4,272,926

DATED : June 16, 1981

INVENTOR(S) : Thomas W. Tamulevich

It is certified that error appears in the above-identified patent and that said Letters Patent are hereby corrected as shown below:

On the first page of the patent, change the title to read --Facet Finishing Tool For Fiber Optic Communication Cable --.

Column 1, line 1, before "Finishing" in the title, change "Face" to --Facet --.

Column 1, line 29, after "operations", change "in" to --is--.

Column 3, line34, change "symthetic" to --synthetic--.

Column 3, line 62, insert --C-- after "130°".

Column 5, line 62, change "fail" to --fall--.

Signed and Sealed this

*Twentieth* Day of *April 1982*

[SEAL]

*Attest:*

GERALD J. MOSSINGHOFF

*Attesting Officer*

*Commissioner of Patents and Trademarks*